US008453550B2

(12) United States Patent
Koide et al.

(10) Patent No.: US 8,453,550 B2
(45) Date of Patent: Jun. 4, 2013

(54) BLAST TREATMENT METHOD AND BLAST TREATMENT DEVICE

(75) Inventors: Kenji Koide, Kobe (JP); Ryusuke Kitamura, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 71 days.

(21) Appl. No.: 13/262,055

(22) PCT Filed: Mar. 24, 2010

(86) PCT No.: PCT/JP2010/002061
§ 371 (c)(1),
(2), (4) Date: Sep. 29, 2011

(87) PCT Pub. No.: WO2010/113424
PCT Pub. Date: Oct. 7, 2010

(65) Prior Publication Data

US 2012/0017751 A1 Jan. 26, 2012

(30) Foreign Application Priority Data

Mar. 31, 2009 (JP) ..... 2009-084660

(51) Int. Cl.
*F42D 5/04* (2006.01)

(52) U.S. Cl.
USPC ..... 86/50

(58) Field of Classification Search
USPC ..... 86/50; 588/403, 401, 313, 249.5, 588/299
See application file for complete search history.

(56) References Cited

U.S. PATENT DOCUMENTS

| | | | | |
|---|---|---|---|---|
| 7,398,720 | B2 * | 7/2008 | Fujiwara et al. | 86/50 |
| 8,006,600 | B2 | 8/2011 | Fujiwara et al. | |
| 2009/0131733 | A1 | 5/2009 | Asahina et al. | |
| 2009/0308235 | A1 * | 12/2009 | Lesage et al. | 86/50 |
| 2012/0137860 | A1 * | 6/2012 | Koide et al. | 86/50 |

FOREIGN PATENT DOCUMENTS

| | | |
|---|---|---|
| JP | 2005 291514 | 10/2005 |
| JP | 2007 271136 | 10/2007 |
| JP | 2007 309550 | 11/2007 |
| JP | 2008 14595 | 1/2008 |

OTHER PUBLICATIONS

International Search Report issued Jul. 13, 2010 in PCT/JP10/002061 filed Mar. 24, 2010.
English Translation of the International Preliminary Report on Patentability with Written Opinion is Nov. 24, 2011, in International application No. PCT/JP2010/002061.

(Continued)

*Primary Examiner* — Michael Carone
*Assistant Examiner* — Reginald Tillman, Jr.
(74) *Attorney, Agent, or Firm* — Oblon, Spivak, McClelland, Maier & Neustadt, L.L.P.

(57) ABSTRACT

A blast treatment method for blasting a treatment subject having an outer shell and a chemical agent charged into an interior of the outer shell includes the steps of: disposing an explosive to cover a periphery of the treatment subject; and detonating the explosive from respective end portions of a specific direction toward a predetermined cutting position of the treatment subject between the respective end portions so that detonation waves of the explosive advancing from respective sides of the cutting position collide in the cutting position, wherein, in the step of detonating the explosive, the chemical agent is exposed by cutting the outer shell in the cutting position through detonation of the explosive, and the chemical agent is decomposed using the detonation.

7 Claims, 5 Drawing Sheets

OTHER PUBLICATIONS

U.S. Appl. No. 13/262,070, filed Sep. 29, 2011, Koide, et al.
U.S. Appl. No. 13/262,419, filed Sep. 30, 2011, Koide, et al.
U.S. Appl. No. 13/262,433, filed Sep. 30, 2011, Fujiwara, et al.
U.S. Appl. No. 13/262,028, filed Sep. 29, 2011, Koide, et al.
U.S. Appl. No. 13/262,245, filed Sep. 30, 2011, Koide, et al.
U.S. Appl. No. 13/262,448, filed Sep. 30, 2011, Asahina, et al.

* cited by examiner

BLAST TREATMENT METHOD AND BLAST TREATMENT DEVICE

TECHNICAL FIELD

The present invention relates to a blast treatment method and a blast treatment device for blasting a treatment subject having an outer shell and a chemical agent charged into an interior of the outer shell.

BACKGROUND ART

Chemical weapons for use by the military (for example, artillery shells, bombs, and so on) in which a chemical agent harmful to the human body is charged into the interior of a steel outer shell, are known in the related art. A treatment method employing blasting is known as a treatment method for rendering such chemical weapons harmless. When a blast treatment method is used, an operation for dismantling the chemical weapon is not required, and therefore this method can be applied to treating not only well-preserved chemical weapons but also chemical weapons that cannot be dismantled easily due to temporal deterioration, deformation, and so on. Another advantage of this method is that substantially all of the chemical agent can be decomposed in an ultra-high temperature field and an ultra-high pressure field generated by an explosion. Patent Document 1 described below, for example, discloses an example of this type of blast treatment method.

In the blast treatment method disclosed in Patent Document 1, chemical ammunition in which an explosive and a chemical agent are housed in an outer shell serves as a treatment subject. ANFO explosive is disposed on an outer periphery of the treatment subject, and a sheet-form explosive having a higher detonation velocity than the ANFO explosive is disposed on an outer periphery of the ANFO explosive. The treatment subject is then blasted by detonating the sheet-form explosive from one end of axial direction side of the treatment subject such that the ANFO explosive on the inside of the sheet-form explosive explodes in response to the detonation. At this time, the explosive in the interior of the treatment subject also explodes, causing the outer shell of the treatment subject to rupture such that the chemical agent in the interior is exposed. The chemical agent is decomposed and rendered harmless by detonation energy from the respective explosives.

Incidentally, treatment subjects include chemical ammunition in which only a chemical agent is charged into the interior of the outer shell, degraded ammunition in which an explosive charge has deteriorated such that it is difficult to initiate, and so on. When these types of treatment subjects are blasted using the blast treatment method of Patent Document 1, it may be impossible to obtain an explosive force from the interior of the treatment subject, or the explosive force from the interior of the treatment subject may be so small that the outer shell of the treatment subject does not rupture sufficiently, and as a result, the chemical agent may not be decomposed sufficiently.

Further, the outer shell may be ruptured sufficiently by increasing an amount of explosive disposed on the outer periphery of the treatment subject, but in this case, a cost increase occurs. Moreover, increases in the amount of explosive are limited due to safety considerations.

Patent Document 1: Japanese Patent Application Publication No. 2005-291514

SUMMARY OF THE INVENTION

An object of the present invention is to provide a blast treatment method and a blast treatment device with which the problems described above are solved.

Another object of the present invention is to provide a blast treatment method and a blast treatment device with which a chemical agent charged into an outer shell of a treatment subject in which only the chemical agent is charged into the outer shell or a treatment subject in which an explosive charge has deteriorated such that it is difficult to initiate can be treated efficiently using a limited amount of explosive.

A blast treatment method according to an aspect of the present invention, for blasting a treatment subject having an outer shell and a chemical agent charged into an interior of the outer shell, includes the steps of: disposing an explosive to cover a periphery of the treatment subject; and detonating the explosive from both end portions of a specific direction toward a predetermined cutting position of the treatment subject between the respective end portions so that detonation waves of the explosive advancing from respective sides of the cutting position collide in the cutting position, wherein, in the step of detonating the explosive, the chemical agent is exposed by cutting the outer shell in the cutting position through detonation of the explosive, and the chemical agent is decomposed using the detonation.

A blast treatment device according to another aspect of the present invention, for blasting a treatment subject having an outer shell and a chemical agent charged into an interior of the outer shell, includes: an inside explosive disposed to cover a periphery of the treatment subject; an outside explosive that has a higher detonation velocity than the inside explosive and is disposed on an outer periphery of the inside explosive to extend from one end portion to another end portion of the inside explosive in a specific direction; and an initiation portion for detonating the outside explosive from both end portions of the outside explosive in the specific direction simultaneously, wherein the outside explosive is disposed to cover an entire periphery of the inside explosive in an orthogonal plane to the specific direction within a range extending to either side of a predetermined cutting position of the treatment subject in the specific direction, and the chemical agent is exposed by cutting the outer shell in the cutting position through detonation of the outside explosive and the inside explosive, and the chemical agent is decomposed using the detonations.

EMBODIMENTS FOR CARRYING OUT THE INVENTION

An embodiment of the present invention will be described below with reference to the drawings.

First, referring to FIGS. 1 to 5, a blast treatment method and a blast treatment device according to this embodiment of the present invention will be described.

Figure 1:
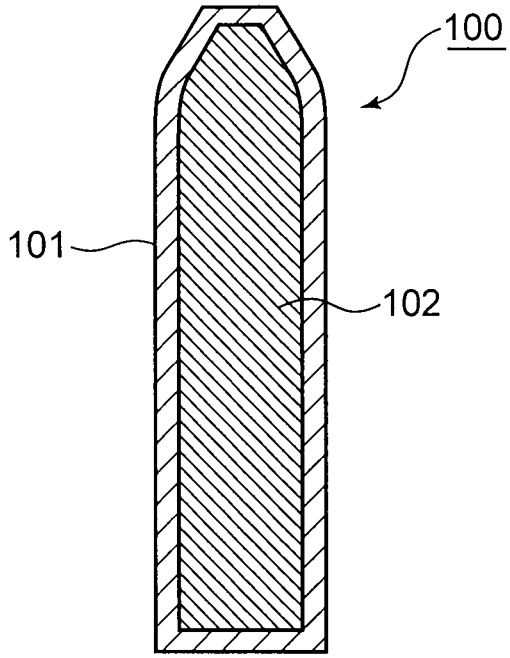
FIG. 1 is a longitudinal sectional view of a treatment subject treated using a blast treatment method according to an embodiment of the present invention.
Figure 2:
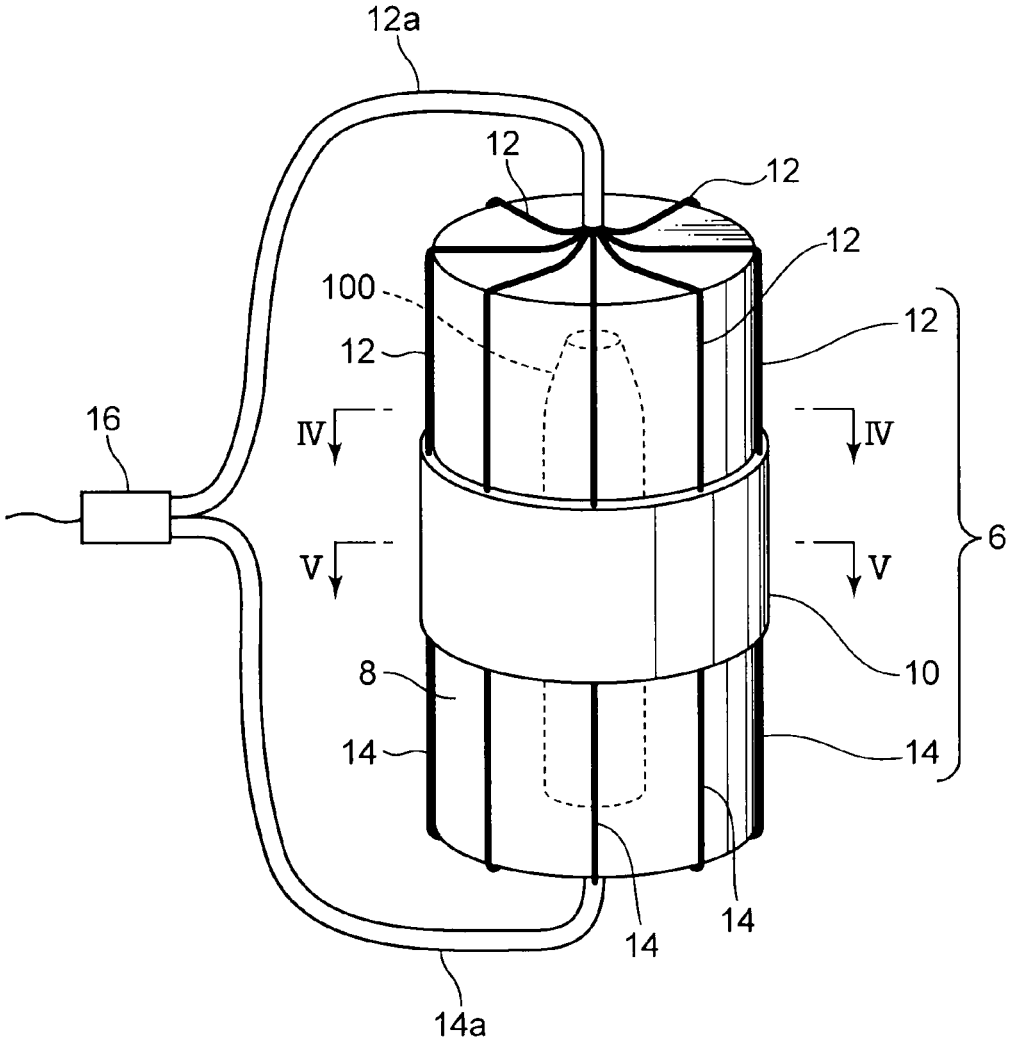
FIG. 2 is a perspective view of a blast treatment device according to this embodiment of the present invention.
Figure 3:
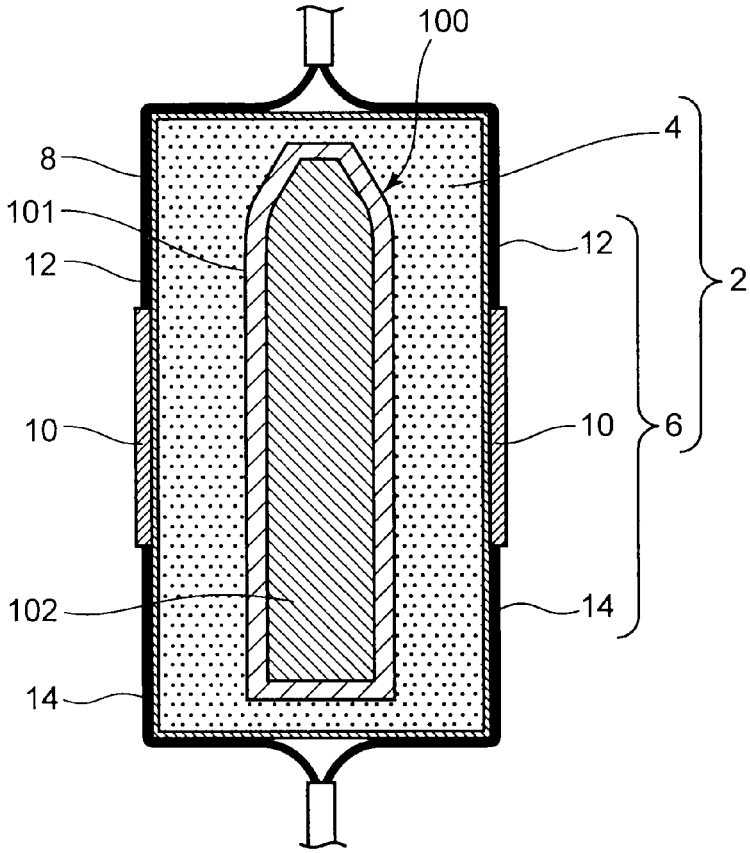
FIG. 3 is a longitudinal sectional view of the blast treatment device shown in FIG. 2.

A treatment subject 100 that is treated using the blast treatment method according to this embodiment is chemical ammunition having an elongated artillery shell-shaped outer form, as shown in FIG. 1. The treatment subject 100 includes a steel shell 101 (an outer shell) and a chemical agent 102 harmful to the human body charged into an interior of the shell 101. In the treatment subject 100, an explosive such as a burster is not provided in the shell 101, and therefore the chemical agent 102 is charged into the shell 101 alone.

In the blast treatment method according to this embodiment, the shell 101 of the treatment subject 100 is cut in a predetermined cutting position by detonating an explosive 2, to be described below, such that the chemical agent 102 is exposed, and the chemical agent is decomposed by the detonation of the explosive 2. In this blast treatment method, a blast treatment device (see FIG. 2) for blasting the treatment subject 100 is manufactured. In a procedure for manufacturing the blast treatment device, first, the explosive 2 (see FIG. 3) is disposed to cover a periphery of the treatment subject 100. The explosive 2 is constituted by an inside explosive 4 and an outside explosive 6.

Figure 4:
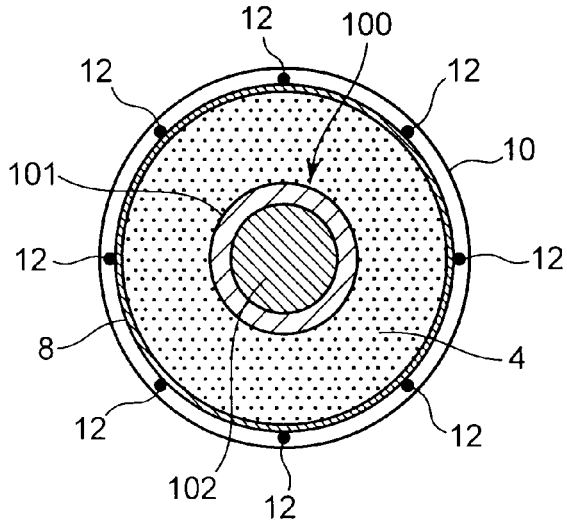
FIG. 4 is a latitudinal sectional view of the blast treatment device shown in FIG. 2, taken along a IV-IV line.
Figure 5:
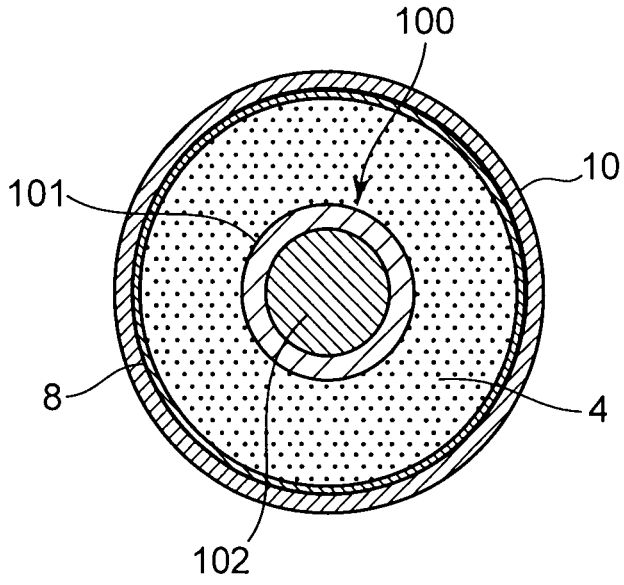
FIG. 5 is a latitudinal sectional view of the blast treatment device shown in FIG. 2, taken along a V-V line.

An explosive having fluidity and a low detonation velocity is used as the inside explosive 4. Examples of this type of explosive include a particulate explosive such as ANFO explosive, an emulsion explosive, a slurry explosive, and so on. The inside explosive 4 is disposed to cover the periphery of the treatment subject 100. More specifically, the periphery of the treatment subject 100 is covered by the inside explosive 4 by charging the inside explosive 4 into a cylindrical case 8 and then burying the treatment subject 100 in the inside explosive 4. At this time, as shown in FIGS. 4 and 5, the treatment subject 100 is disposed substantially coaxially with the case 8.

An explosive having a higher detonation velocity than the inside explosive 4 is used as the outside explosive 6. The outside explosive 6 is disposed around an outer periphery of the inside explosive 4, or more specifically around an outer periphery of the case 8, from one axial direction end portion to another axial direction end portion of the inside explosive 4. In this embodiment, the outside explosive 6 is constituted by an explosive sheet 10, a plurality of first cord-shaped bodies 12, and a plurality of second cord-shaped bodies 14. A clay sheet-form material formed by incorporating a PETN explosive, an RDX explosive, or the like having a higher detonation velocity than the inside explosive 4 into wax, or similar is used as the explosive sheet 10. Further, the first cord-shaped bodies 12 and second cord-shaped bodies 14 are formed from similar types of materials. The first cord-shaped bodies 12 and the second cord-shaped bodies 14 are formed respectively from a cord-shaped material having a higher detonation velocity than the inside explosive 4 and extending in a single direction. More specifically, a detonating cord formed by packing an explosive having a higher detonation velocity than the inside explosive 4 into a plastic tube, an explosive sheet cut into a cord shape, or similar is used as the first cord-shaped bodies 12 and second cord-shaped bodies 14.

In a procedure for disposing the outside explosive 6, first, the explosive sheet 10 is wrapped around an outer peripheral surface of the cylindrical case 8. At this time, the explosive sheet 10 is disposed to cover the entire periphery of the case 8, or in other words the entire periphery of the inside explosive 4, in an orthogonal plane to the axial direction of the treatment subject 100 within a predetermined range extending to either side of a cutting position of the shell 101 in the axial direction. Note that in this embodiment, the explosive sheet 10 is disposed in a range close to an axial direction central portion of the inside explosive 4.

Next, the plurality of first cord-shaped bodies 12 and the plurality of second cord-shaped bodies 14 are disposed on the outer peripheral surface of the case 8, or in other words the outer periphery of the inside explosive 4. More specifically, the plurality of first cord-shaped bodies 12 are disposed to extend along the outer peripheral surface of the case 8 from the top of an end surface of the case 8 positioned in one axial direction end portion of the inside explosive 4, and connected to an end portion, which is positioned on the one end portion of the inside explosive 4, of the explosive sheet 10. At this time, as shown in FIG. 4, the plurality of first cord-shaped bodies 12 are disposed at equal circumferential intervals around the outer periphery of the case 8, or in other words the outer periphery of the inside explosive 4. Further, the plurality of second cord-shaped bodies 14 are disposed to extend along the outer peripheral surface of the case 8 from the top of an end surface of the case 8 positioned in the other axial direction end portion of the inside explosive 4, and connected to an end portion of the explosive sheet 10, which is on the other end side of the inside explosive 4. At this time, the plurality of second cord-shaped bodies 14 are disposed at equal circumferential direction intervals around the outer periphery of the case 8, or in other words the outer periphery of the inside explosive 4. Note that the cord-shaped bodies 12, 14 disposed on the outer peripheral surface of the case 8 are formed to have substantially equal lengths.

The plurality of first cord-shaped bodies 12 are then gathered together and extended from the one axial direction end portion of the case 8 while the plurality of second cord-shaped bodies 14 are gathered together and extended from the other axial direction end portion of the case 8. At this time, a length of an extended part 12*a* of the first cord-shaped bodies 12 is set to be equal to a length of an extended part 14*a* of the second cord-shaped bodies 14. An end portion of the extended part 12*a* of the first cord-shaped bodies 12, or in other words an end portion of the first cord-shaped bodies 12 on an opposite side to the end portion connected to the explosive sheet 10, and an end portion of the extended part 14*a* of the second cord-shaped bodies 14, or in other words an end portion of the second cord-shaped bodies 14 on an opposite side to the end portion connected to the explosive sheet 10, are connected to a common electric detonator 16. Note that the electric detonator 16 is included in the concept of an initiation unit according to the present invention.

Thus, the blast treatment device according to this embodiment is manufactured.

Next, blast treatment is performed on the treatment subject 100 using the blast treatment device manufactured as described above. In the blast treatment, the blast treatment device is housed in the interior of a chamber, not shown in the drawings, and the respective explosives are detonated within the chamber.

In a specific process of the blast treatment, first, the first cord-shaped bodies 12 and second cord-shaped bodies 14 are initiated and detonated from the respective end portions thereof by the electric detonator 16. As a result, detonation of the first cord-shaped bodies 12 reaches the one axial direction end portion of the inside explosive 4 via the extended part 12*a* at the same time as detonation of the second cord-shaped bodies 14 reaches the other axial direction end portion of the inside explosive 4 via the extended part 14*a*. At this time, the case 8 is ruptured by the detonation of the first cord-shaped bodies 12 such that the inside explosive 4 is initiated from the one axial direction end portion, and simultaneously, the case 8 is ruptured by the detonation of the second cord-shaped bodies 14 such that the inside explosive 4 is initiated from the other axial direction end portion. The first cord-shaped bodies 12 and second cord-shaped bodies 14 then detonate from the respective axial direction end portions of the inside explosive 4 toward the explosive sheet 10 while the inside explosive 4 detonates from the respective axial direction end portions toward the axial direction central portion. Here, the detonation velocity of the first cord-shaped bodies 12 and second cord-shaped bodies 14 is higher than the detonation velocity of the inside explosive 4, and therefore the detonation of the inside explosive 4 advances at a delay relative to advancement of the detonations of the first cord-shaped bodies 12 and second cord-shaped bodies 14.

The detonations of the first cord-shaped bodies 12 and the second cord-shaped bodies 14 reach the explosive sheet 10 substantially simultaneously. As a result, the explosive sheet 10 detonates from both ends of the inside explosive 4 in an axial direction. The detonation velocity of the explosive sheet 10 is higher than the detonation velocity of the inside explosive 4, and therefore the detonation of the inside explosive 4 advances at a delay relative to advancement of the detonation of the explosive sheet 10. Detonation waves advancing from both sides of the explosive sheet 10 collide in a cutting position positioned substantially centrally in the axial direction of the explosive sheet 10, and detonation waves advancing in the inside explosive 4 from both sides of the cutting position collide at a delay relative thereto.

High-pressure gas having greater energy than a single detonation wave is generated by the collision between the detonation waves in the explosive sheet 10 and the collision between the detonation waves in the inside explosive 4. Here, the explosive sheet 10 is disposed to cover the entire periphery of the inside explosive 4 in an orthogonal plane to the axial direction within a range extending to either side of the cutting position in the axial direction, and therefore the high-pressure gas generated in the cutting position by the collision between the detonation waves in the explosive sheet 10 seals in the high-pressure gas generated subsequently by the collision between the detonation waves in the inside explosive 4. Accordingly, the pressure of the high-pressure gas generated by the collision between the detonation waves in the inside explosive 4 increases further, and this high-pressure gas travels toward radially inward. The shell 101 of the treatment subject 100 is cut in a radial direction inward orientation by the high-pressure gas such that the internal chemical agent 102 is exposed. The exposed chemical agent 102 is decomposed by the high-pressure gas and thereby rendered harmless. Thus, the treatment subject 100 is subjected to the blast treatment according to this embodiment.

In this embodiment, as described above, high-pressure gas having greater energy than a single detonation wave is generated in a concentrated fashion in the cutting position of the shell 101 by the collisions between the detonation waves advancing from the respective axial direction end sides. Hence, the shell 101 of the treatment subject 100 can be cut inwardly by the generated high-pressure gas with a high degree of reliability, and therefore the chemical agent 102 charged into the interior of the shell 101 can be exposed reliably and decomposed sufficiently by the high-pressure gas. As a result, the chemical agent charged into the shell 101 of the treatment subject 100, in which only the chemical agent is charged into the shell 101, can be decomposed and rendered harmless without increasing the amount of explosive. Hence, according to this embodiment, the chemical agent 102 charged into the shell 101 of the treatment subject 100, in which only the chemical agent 102 is charged into the shell 101, can be treated efficiently using a limited amount of explosive.

Further, in this embodiment, the explosive sheet 10 serving as a part of the outside explosive 6 is disposed to cover the entire periphery of the inside explosive 4 in an orthogonal plane to the axial direction within a range extending to either side of the cutting position in the axial direction, the outside explosive 6 is detonated from the respective axial direction sides, and the inside explosive 4 is detonated from the respective axial direction end portions in response to detonation of the outside explosive 6. With this constitution, the detonation waves from the respective ends of the outside explosive 6 (the explosive sheet 10) having a higher detonation velocity collide in the cutting position first, and the detonation waves from the respective ends of the inside explosive 4 collide at a delay relative thereto. The high-pressure gas generated in the cutting position at this time by the collision between the detonation waves from the outside explosive 6 seals in the high-pressure gas generated subsequently by the collision between the detonation waves in the inside explosive 4. Accordingly, the pressure of the high-pressure gas generated by the collision between the detonation waves in the inside explosive 4 can be increased further, and this high-pressure gas can be oriented inwardly with a high degree of reliability. As a result, the shell 101 of the treatment subject 100 positioned in the interior of the inside explosive 4 can be cut more reliably by the high-pressure gas.

Furthermore, in this embodiment, the first cord-shaped bodies 12 having a higher detonation velocity than the inside explosive 4 are disposed along the outer periphery of the inside explosive 4 from the one axial direction end portion of the inside explosive 4 and connected to the end portion of the explosive sheet 10 positioned on the one end portion side of the inside explosive 4, and the second cord-shaped bodies 14 having an equal detonation velocity to the first cord-shaped bodies 12 are disposed along the outer periphery of the inside explosive 4 from the other axial direction end portion of the inside explosive 4 and connected to the end portion of the explosive sheet 10 positioned on the other end portion side of the inside explosive 4. With this constitution, the explosive sheet 10 is disposed around the entire periphery of the inside explosive 4 in the cutting position, and therefore the shell 101 of the treatment subject 100 can be cut in the cutting position reliably, while reducing an amount of explosive used in the part where the first cord-shaped bodies 12 and second cord-shaped bodies 14 are disposed. Hence, in this embodiment, the shell 101 of the treatment subject 100 can be cut in the cutting position reliably while limiting the amount of explosive used in other parts, and as a result, a cost reduction can be achieved.

Moreover, in this embodiment, the plurality of first cord-shaped bodies 12 are disposed at equal intervals on the outer periphery of the inside explosive 4 and the plurality of second cord-shaped bodies 14 are disposed at equal intervals on the outer periphery of the inside explosive 4. Therefore, the inside explosive 4 can be detonated from the outer periphery thereof by the plurality of first cord-shaped bodies 12 and the plurality of second cord-shaped bodies 14 with favorable balance.

Further, in this embodiment, the blast treatment is performed in a chamber, and therefore leakage of the chemical agent 102, scattering of the shell 101 of the blasted treatment subject 100, and so on can be limited to within the chamber so that adverse effects thereof on the external environment can be prevented.

Note that the embodiment disclosed herein is in all respects merely an example and is not to be considered limiting. The scope of the present invention is indicated by the claims rather than the description of the above embodiment, and all modifications within the scope of the present invention and having an equivalent meaning to the claims are included therein.

For example, in the above embodiment, chemical ammunition in which an explosive such as a burster is not provided in the interior of the shell 101 and the chemical agent 102 is charged alone is used as the treatment subject 100, but the present invention is not limited thereto, and the blast treatment method and blast treatment device according to the present invention may also be used on a treatment subject other than the chemical ammunition described in the above embodiment. More specifically, chemical ammunition in which a burster and a chemical agent are housed in an outer shell but the burster is deteriorated such that it is difficult to initiate may be treated as a treatment subject using the blast treatment method and blast treatment device according to the present invention. In this type of chemical ammunition, it is very difficult to initiate the burster, and it may therefore be impossible to rupture the outer shell sufficiently with a conventional blast treatment method in which the outer shell is ruptured using internal explosive force. With the blast treatment method and blast treatment device according to the present invention, however, the outer shell can be cut reliably, thereby exposing the chemical agent, even in this type of chemical ammunition, whereupon the chemical agent can be decomposed sufficiently by the high-pressure gas generated upon detonation of the explosive 2, as described above.

Furthermore, in the above embodiment, chemical ammunition having an elongated artillery shell-shaped outer form is used as the treatment subject 100, but the present invention is not limited thereto, and the blast treatment method and blast treatment device according to the present invention may be applied to treatment subjects having various outer forms. For example, treatment subjects having a spherical shape, an asymmetrical shape, and various other shapes may be blasted similarly.

Further, in the above embodiment, chemical ammunition is used as the treatment subject 100, but the present invention is not limited thereto, and chemical weapons other than chemical ammunition may be used as treatment subjects. For example, chemical weapons such as landmines, chemical weapons formed by sealing a chemical agent in a can or sealing a chemical agent in a bottle, and so on may be used as treatment subjects.

Furthermore, the inside explosive 4 may be provided alone without providing the outside explosive 6, and the inside explosive 4 may be detonated from the respective axial direction end portions toward the cutting position therebetween.

Moreover, the explosive sheet 10 may be omitted, and the first cord-shaped bodies 12 and second cord-shaped bodies 14 may be extended to the axial direction central portion of the inside explosive 4. Likewise with this constitution, the first cord-shaped bodies 12 and second cord-shaped bodies 14 can be initiated from the respective axial direction end sides such that upon detonation of the first and second cord-shaped bodies 12, 14, the inside explosive 4 is detonated from the respective axial direction end portions toward the cutting position therebetween.

Further, the first cord-shaped bodies 12 and second cord-shaped bodies 14 may be omitted, and an explosive sheet may be disposed to extend over the entire inside explosive 4 from the one axial direction end portion to the other axial direction end portion. The explosive sheet may then be initiated from the respective axial direction end portions such that upon detonation of the explosive sheet, the inside explosive 4 is detonated from the respective axial direction end portions.

Furthermore, in the above embodiment, the end portion of the extended part 12*a* of the first cord-shaped bodies 12 extending from the one axial direction end portion of the inside explosive 4 and the end portion of the extended part 14*a* of the second cord-shaped bodies 14 extending from the other axial direction end portion of the inside explosive 4 are connected to the common electric detonator 16. However, the plurality of first cord-shaped bodies 12 may be gathered together in a position near the one axial direction end portion of the inside explosive 4 and connected to an electric detonator exhibiting a high degree of temporal precision, and the plurality of second cord-shaped bodies 14 may be gathered together in a position near the other axial direction end portion of the inside explosive 4 and connected to another electric detonator exhibiting a high degree of temporal precision. The first cord-shaped bodies 12 and the second cord-shaped bodies 14 may then be initiated simultaneously by the two electric detonators from the respective axial direction end portion sides.

Moreover, in this embodiment, various cases may be used as the case 8 as long as the inside explosive 4 can be charged therein and as long as the case ruptures when the outside explosive 6 is detonated such that the detonation of the outside explosive 6 is transmitted to the inside explosive 4, thereby detonating the inside explosive 4. For example, a plastic case, a case formed from various materials other than plastic, a sheet or a bag made of plastic resin, and so on may be used as the case 8.

Figure 6:
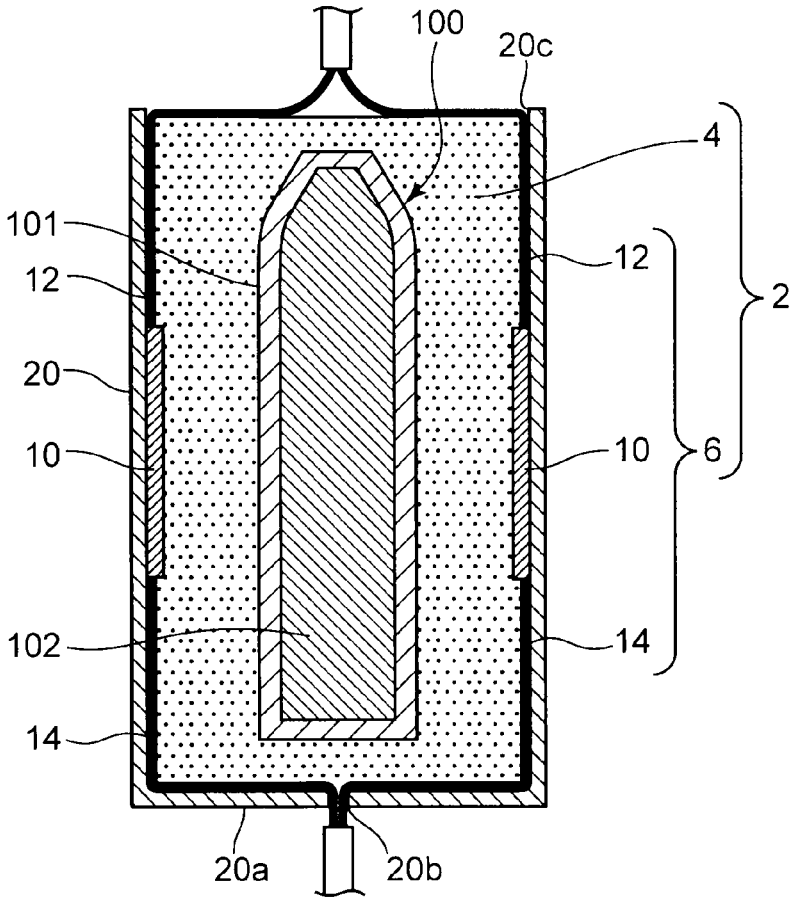
FIG. 6 is a longitudinal sectional view of a blast treatment device according to a modified example of this embodiment of the present invention.
Figure 7:
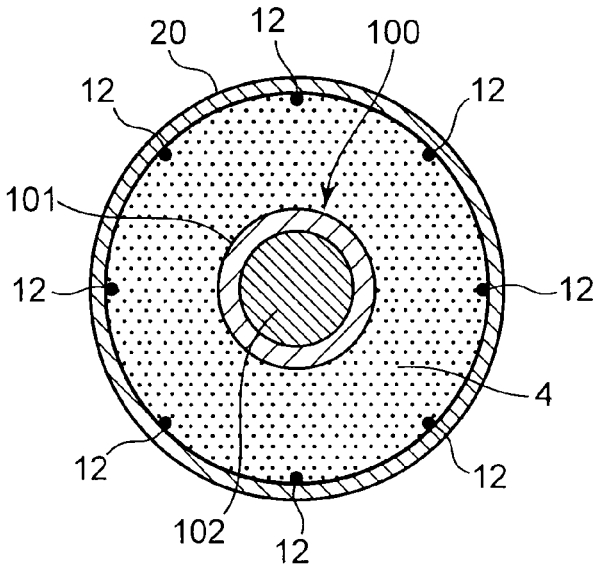
FIG. 7 is a latitudinal sectional view of the blast treatment device according to the modified example shown in FIG. 6, corresponding to FIG. 4.

Further, in this embodiment, the outside explosive 6 is disposed on the outer periphery of the inside explosive 4 by charging the inside explosive 4 into the case 8 and disposing the outside explosive 6 on the outer peripheral surface of the case 8, but the blast treatment method and blast treatment device according to the present invention are not limited to this constitution, and in a blast treatment method according to a modified example of this embodiment, a blast treatment device according to the modified example is manufactured as shown in FIGS. 6 and 7, whereupon the treatment subject 100 is blasted using this blast treatment device.

More specifically, in the blast treatment device according to the modified example, the treatment subject 100, the inside explosive 4, and the outside explosive 6 are disposed using a closed-end cylindrical tubular body 20. In a procedure for disposing the treatment subject 100, the inside explosive 4, and the outside explosive 6 according to the modified example, first, the explosive sheet 10, the first cord-shaped bodies 12, and the second cord-shaped bodies 14 of the outside explosive 6 are disposed on an inner peripheral surface of the tubular body 20. More specifically, the explosive sheet 10 is adhered to the inner peripheral surface of the tubular body 20 around the entire periphery thereof within the axial direction disposal range of the explosive sheet 10. Further, the plurality of first cord-shaped bodies 12 are disposed along the inner peripheral surface of the tubular body 20 from an end portion of the explosive sheet 10 positioned on an opening portion 20*c* side of the tubular body 20 to the opening portion 20*c* side of the tubular body 20. The plurality of second cord-shaped bodies 14 are disposed along the inner peripheral surface of the tubular body 20 from an end portion of the explosive sheet 10 positioned on a bottom wall portion 20*a* side of the tubular body 20 to the bottom wall portion 20*a* side of the tubular body 20, then extended to the radial direction inner side along an inner surface of the bottom wall portion 20*a* of the tubular body 20, passed through a through hole 20*b* formed in the bottom wall portion 20*a*, and disposed externally. Next, the inside explosive 4 is charged into the tubular body 20 up to the vicinity of the opening portion 20*c*. The treatment subject 100 is then buried in the inside explosive 4. Thus, the inside explosive 4 is disposed to cover the periphery of the treatment subject 100 and the outside explosive 6 is disposed on the outer periphery of the inside explosive 4.

Outline of Embodiments

The embodiment and modified example described above can be summarized as follows.

The blast treatment method according to the embodiment and modified example described above is a method for blasting a treatment subject having an outer shell and a chemical agent charged into an interior of the outer shell, including the steps of: disposing an explosive to cover a periphery of the treatment subject; and detonating the explosive from respective end portions of a specific direction toward a predetermined cutting position of the treatment subject between the respective end portions so that detonation waves of the explosive advancing from respective sides of the cutting position collide in the cutting position, wherein, in the step of detonating the explosive, the chemical agent is exposed by cutting the outer shell in the cutting position through detonation of the explosive, and the chemical agent is decomposed using the detonation.

In this blast treatment method, high-pressure gas having greater energy than a single detonation wave is generated in a concentrated fashion in the cutting position by the collision between the detonation waves of the explosive advancing from either side of the specific direction. Hence, the outer shell of the treatment subject can be cut inwardly using the generated high-pressure gas with a high degree of reliability, and therefore the chemical agent charged into the interior of the outer shell can be exposed reliably and decomposed sufficiently by the high-pressure gas. As a result, the chemical agent charged into the outer shell of a treatment subject in which only the chemical agent is charged into the outer shell or a treatment subject in which an explosive charge has deteriorated such that it is difficult to initiate can be decomposed and rendered harmless without increasing the amount of explosive. Hence, with this blast treatment method, the chemical agent charged into the outer shell of a treatment subject in which only the chemical agent is charged into the outer shell or a treatment subject in which an explosive charge has deteriorated such that it is difficult to initiate can be treated efficiently using a limited amount of explosive.

In the blast treatment method described above, the step of disposing the explosive preferably includes the steps of disposing an inside explosive to cover the periphery of the treatment subject, and disposing an outside explosive having a higher detonation velocity than the inside explosive on an outer periphery of the inside explosive to extend from one end portion to another end portion of the inside explosive in the specific direction. Further, in the step of disposing the outside explosive, the outside explosive is preferably disposed to cover an entire periphery of the inside explosive in an orthogonal plane to the specific direction within a range extending to either side of the cutting position in the specific direction, and in the step of detonating the explosive, the outside explosive is preferably detonated from respective end portions of the specific direction and the inside explosive is detonated from the respective end portions of the specific direction through detonation of the outside explosive.

With this constitution, the outside explosive having a high detonation velocity detonates from the respective end portions of the specific direction toward the cutting position, and the inside explosive detonates from the respective end portions of the specific direction toward the cutting position at a delay relative thereto. Therefore, the detonation waves from the respective ends of the inside explosive collide in the cutting position at a delay relative to the collision between the detonation waves from the respective ends of the outside explosive. At this time, the outside explosive is disposed to cover the entire periphery of the inside explosive in the orthogonal plane to the specific direction within the range extending to either side of the cutting position in the specific direction, and therefore the high-pressure gas generated when the detonation waves from the outside explosive collide in the cutting position seals in the high-pressure gas generated when the detonation waves of the inside explosive collide subsequently. Accordingly, the pressure of the high-pressure gas generated by the collision between the detonation waves in the inside explosive can be increased further, and this high-pressure gas can be oriented inwardly with a high degree of reliability. As a result, the outer shell of the treatment subject positioned in the interior of the inside explosive can be cut more reliably by the high-pressure gas.

In this case, the step of disposing the outside explosive preferably includes the steps of: covering the entire periphery of the inside explosive in an orthogonal plane to the specific direction with an explosive sheet formed in a sheet form and containing an explosive having a higher detonation velocity than the inside explosive, within a predetermined range in between the respective end portions of the inside explosive in the specific direction and on either side of the cutting position; disposing a first cord-shaped body formed in a cord shape and containing an explosive having a higher detonation velocity than the inside explosive along the outer periphery of the inside explosive from the one end portion of the inside explosive in the specific direction, and connecting the first cord-shaped body to an end portion of the explosive sheet positioned on the one end portion side of the inside explosive; and disposing a second cord-shaped body formed in a cord shape and containing an explosive having an equal detonation velocity to the explosive of the first cord-shaped body along the outer periphery of the inside explosive from the other end portion of the inside explosive in the specific direction, and connecting the second cord-shaped body to an end portion of the explosive sheet positioned on the other end portion side of the inside explosive, and in the step of detonating the explosive, the first cord-shaped body and the second cord-shaped body are preferably detonated from the respective ends of the inside explosive in the specific direction such that the inside explosive is detonated from the respective end portions of the specific direction through detonation of the first cord-shaped body and the second cord-shaped body, and when the detonation of the first cord-shaped body and the detonation of the second cord-shaped body reach the explosive sheet, the explosive sheet is detonated from the respective end portions of the specific direction.

With this constitution, the outer shell of the treatment subject can be cut reliably in the cutting position by disposing the explosive sheet around the entire periphery of the inside explosive, and the amount of explosive used in the disposal range of the first cord-shaped body and second cord-shaped body can be reduced. Hence, with this constitution, the outer shell of the treatment subject can be cut in the cutting position reliably while limiting the amount of explosive used in other parts, and as a result, a cost reduction can be achieved.

Furthermore, in this case, in the step of disposing the first cord-shaped body, a plurality of the first cord-shaped bodies are preferably disposed on the outer periphery of the inside explosive at equal intervals in a circumferential direction, and in the step of disposing the second cord-shaped body, a plurality of the second cord-shaped bodies are preferably disposed on the outer periphery of the inside explosive at equal intervals in the circumferential direction.

With this constitution, the inside explosive can be detonated from the outer periphery thereof by the plurality of first cord-shaped bodies and the plurality of second cord-shaped bodies with favorable balance.

Further, in the blast treatment method described above, the step of detonating the explosive is preferably performed in a chamber.

With this constitution, leakage of the chemical agent, scattering of the outer shell of the blasted treatment subject, and so on can be limited to within the chamber so that adverse effects thereof on the external environment can be prevented.

Further, the blast treatment device according to the embodiment and modified example described above is a device for blasting a treatment subject having an outer shell and a chemical agent charged into an interior of the outer shell, including: an inside explosive disposed to cover a periphery of the treatment subject; an outside explosive that has a higher detonation velocity than the inside explosive and is disposed on an outer periphery of the inside explosive to extend from one end portion to another end portion of the inside explosive in a specific direction; and an initiation portion for detonating the outside explosive from both end portions of the outside explosive in the specific direction simultaneously, wherein the outside explosive is disposed to cover an entire periphery of the inside explosive in an orthogonal plane to the specific direction within a range extending to either side of a predetermined cutting position of the treatment subject in the specific direction, and the chemical agent is exposed by cutting the outer shell in the cutting position through detonation of the outside explosive and the inside explosive, and the chemical agent is decomposed using the detonations.

In this blast treatment device, the outside explosive can be detonated by the initiation portion from both end portions of the specific direction simultaneously, and the inside explosive can be detonated from both end portions of the specific direction through detonation of the outside explosive. Therefore, detonation waves advancing from the respective ends of the outside explosive having a high detonation velocity collide in the cutting position first, followed at a delay by detonation waves advancing form the respective ends of the inside explosive. When the detonation waves collide from either side in this manner, high-pressure gas having greater energy than a single detonation wave is generated in a concentrated fashion in the cutting position. In the blast treatment device, the outside explosive is disposed to cover the entire outer periphery of the inside explosive in the orthogonal plane to the specific direction within the range extending to either side of the cutting position in the specific direction, and therefore the high-pressure gas generated when the detonation waves in the outside explosive collide in the cutting position seals in the high-pressure gas generated when the detonation waves in the inside explosive collide subsequently. Accordingly, the pressure of the high-pressure gas generated by the collision between the detonation waves in the inside explosive can be increased further, and this high-pressure gas can be oriented inwardly so that the outer shell of the treatment subject can be cut more reliably by this high-pressure gas. Hence, the chemical agent charged into the interior of the outer shell can be exposed reliably and the exposed chemical agent can be decomposed sufficiently by the high-pressure gas. As a result, the chemical agent charged into the outer shell of a treatment subject in which only the chemical agent is charged into the outer shell or a treatment subject in which an explosive charge has deteriorated such that it is difficult to initiate can be decomposed and rendered harmless without increasing the amount of explosive. Therefore, with this blast treatment device, the chemical agent charged into the outer shell of a treatment subject in which only the chemical agent is charged into the outer shell or a treatment subject in which an explosive charge has deteriorated such that it is difficult to initiate can be treated efficiently using a limited amount of explosive.

In the blast treatment device described above, the outside explosive preferably includes: an explosive sheet which is provided to cover the entire periphery of the inside explosive in the orthogonal plane to the specific direction within a predetermined range in between the respective end portions of the inside explosive in the specific direction and on either side of the cutting position, is formed in a sheet form and contains an explosive having a higher detonation velocity than the inside explosive; a first cord-shaped body which is disposed along the outer periphery of the inside explosive from the one end portion of the inside explosive in the specific direction and connected to an end portion of the explosive sheet positioned on the one end portion side of the inside explosive, is formed in a cord shape and contains an explosive having a higher detonation velocity than the inside explosive; and a second cord-shaped body which is disposed along the outer periphery of the inside explosive from the other end portion of the inside explosive in the specific direction and connected to an end portion of the explosive sheet positioned on the other end portion side of the inside explosive, is formed in a cord shape and contains an explosive having an equal detonation velocity to the explosive of the first cord-shaped body, and the initiation portion is preferably connected to an end portion of the first cord-shaped body on an opposite side to an end portion thereof connected to the explosive sheet, and an end portion of the second cord-shaped body on an opposite side to an end portion thereof connected to the explosive sheet.

With this constitution, the outer shell of the treatment subject can be cut reliably in the cutting position by disposing the explosive sheet around the entire periphery of the inside explosive, and the amount of explosive used in the disposal range of the first cord-shaped body and second cord-shaped body can be reduced. Hence, with this constitution, the outer shell of the treatment subject can be cut in the cutting position reliably while limiting the amount of explosive used in other parts, and as a result, a cost reduction can be achieved.

According to the embodiment described above, a chemical agent charged into an outer shell of a treatment subject in which only the chemical agent is charged into the outer shell, or a treatment subject in which an explosive charge has deteriorated such that it is difficult to initiate, can be treated efficiently using a limited amount of explosive.

The invention claimed is:

1. A blast treatment method for blasting a treatment subject having an outer shell and a chemical agent charged into an interior of the outer shell, comprising the steps of:

disposing an explosive to cover a periphery of the treatment subject; and detonating the explosive from respective end portions of a specific direction toward a predetermined cutting position of the treatment subject between the respective end portions so that detonation waves of the explosive advancing from respective sides of the cutting position collide in the cutting position, wherein, in the step of detonating the explosive, the chemical agent is exposed by cutting the outer shell in the cutting position through detonation of the explosive, and the chemical agent is decomposed using the detonation.

2. The blast treatment method according to claim 1, wherein the step of disposing the explosive includes the steps of disposing an inside explosive to cover the periphery of the treatment subject, and disposing an outside explosive having a higher detonation velocity than the inside explosive on an outer periphery of the inside explosive to extend from one end portion to another end portion of the inside explosive in the specific direction, in the step of disposing the outside explosive, the outside explosive is disposed to cover an entire periphery of the inside explosive in an orthogonal plane to the specific direction within a range extending to either side of the cutting position in the specific direction, and in the step of detonating the explosive, the outside explosive is detonated from respective end portions of the specific direction, and the inside explosive is detonated from the respective end portions of the specific direction through detonation of the outside explosive.

3. The blast treatment method according to claim 2, wherein the step of disposing the outside explosive includes the steps of:

covering the entire periphery of the inside explosive in an orthogonal plane to the specific direction with an explosive sheet formed in a sheet form and containing an explosive having a higher detonation velocity than the inside explosive, within a predetermined range in between the respective end portions of the inside explosive in the specific direction and on either side of the cutting position;

disposing a first cord-shaped body formed in a cord shape and containing an explosive having a higher detonation velocity than the inside explosive along the outer periphery of the inside explosive from the one end portion of the inside explosive in the specific direction, and connecting the first cord-shaped body to an end portion of the explosive sheet positioned on the one end portion side of the inside explosive; and disposing a second cord-shaped body formed in a cord shape and containing an explosive having an equal detonation velocity to the explosive of the first cord-shaped body along the outer periphery of the inside explosive from the other end portion of the inside explosive in the specific direction, and connecting the second cord-shaped body to an end portion of the explosive sheet positioned on the other end portion side of the inside explosive, and in the step of detonating the explosive, the first cord-shaped body and the second cord-shaped body are detonated from the respective ends of the inside explosive in the specific direction such that the inside explosive is detonated from the respective end portions of the specific direction through detonation of the first cord-shaped body and the second cord-shaped body, and when the detonation of the first cord-shaped body and the detonation of the second cord-shaped body reach the explosive sheet, the explosive sheet is detonated from the respective end portions of the specific direction.

4. The blast treatment method according to claim 3, wherein in the step of disposing the first cord-shaped body, a plurality of the first cord-shaped bodies are disposed on the outer periphery of the inside explosive at equal intervals in a circumferential direction, and in the step of disposing the second cord-shaped body, a plurality of the second cord-shaped bodies are disposed on the outer periphery of the inside explosive at equal intervals in the circumferential direction.

5. The blast treatment method according to claim 1, wherein the step of detonating the explosive is performed in a chamber.

6. A blast treatment device for blasting a treatment subject having an outer shell and a chemical agent charged into an interior of the outer shell, comprising:

an inside explosive disposed to cover a periphery of the treatment subject;

an outside explosive that has a higher detonation velocity than the inside explosive and is disposed on an outer periphery of the inside explosive to extend from one end portion to another end portion of the inside explosive in a specific direction; and an initiation portion for detonating the outside explosive from both end portions of the outside explosive in the specific direction simultaneously, wherein the outside explosive is disposed to cover an entire periphery of the inside explosive in an orthogonal plane to the specific direction within a range extending to either side of a predetermined cutting position of the treatment subject in the specific direction, and the chemical agent is exposed by cutting the outer shell in the cutting position through detonation of the outside explosive and the inside explosive, and the chemical agent is decomposed using the detonations.

7. The blast treatment device according to claim 6, wherein the outside explosive includes:

an explosive sheet which is provided to cover the entire periphery of the inside explosive in the orthogonal plane to the specific direction within a predetermined range in between the respective end portions of the inside explosive in the specific direction and on either side of the cutting position, is formed in a sheet form and contains an explosive having a higher detonation velocity than the inside explosive;

a first cord-shaped body which is disposed along the outer periphery of the inside explosive from the one end portion of the inside explosive in the specific direction and connected to an end portion of the explosive sheet positioned on the one end portion side of the inside explosive, is formed in a cord shape and contains an explosive having a higher detonation velocity than the inside explosive; and a second cord-shaped body which is disposed along the outer periphery of the inside explosive from the other end portion of the inside explosive in the specific direction and connected to an end portion of the explosive sheet positioned on the other end portion side of the inside explosive, is formed in a cord shape and contains an explosive having an equal detonation velocity to the explosive of the first cord-shaped body, and the initiation portion is connected to an end portion of the first cord-shaped body on an opposite side to an end portion thereof connected to the explosive sheet, and an end portion of the second cord-shaped body on an opposite side to an end portion thereof connected to the explosive sheet.

* * * * *